United States Patent [19]

Couty

[11] Patent Number: 4,823,484

[45] Date of Patent: Apr. 25, 1989

[54] SKI BOOT CLOSURE DEVICE

[75] Inventor: Catherine Couty, Annecy, France

[73] Assignee: Salomon S. A., Annecy, France

[21] Appl. No.: 130,493

[22] Filed: Dec. 8, 1987

[30] Foreign Application Priority Data

Dec. 8, 1986 [FR] France ..... 86 17517

[51] Int. Cl.[4] ..... A43B 5/04; A43C 11/00

[52] U.S. Cl. ..... 36/117; 36/50; 24/68 SK

[58] Field of Search ..... 36/117–121, 36/50, 105; 24/68 SK, 69 SK, 70 SK, 71 SK; 242/157 R

[56] References Cited

U.S. PATENT DOCUMENTS 4,083,129 4/1978 Collombin et al. ..... 36/117
4,222,184 9/1980 Kastinger ..... 36/121
4,571,855 2/1986 Blanc ..... 36/50
4,691,454 9/1987 Ottieri ..... 36/117

FOREIGN PATENT DOCUMENTS 0237633 9/1987 European Pat. Off. ..... 36/117
0240967 10/1987 European Pat. Off. ..... 36/117

*Primary Examiner*—James Kee Chi
*Attorney, Agent, or Firm*—Pollock, Vande Sande & Priddy

[57] ABSTRACT

A device for guiding and retaining a system designed to tighten and/or close two mutually movable parts of a ski boot. The device consists of a recessed key (12) that may be inserted into an opening (13) provided in a part of the boot, the recessed portion of the key forming a channel within which at least one traction cable (9) may slip freely, the cable (9) being sandwiched between the outer surface (5''') of the boot part and the solid bottom (20) of the key.

8 Claims, 2 Drawing Sheets

SKI BOOT CLOSURE DEVICE

FIELD OF THE INVENTION

The invention relates to a rear entry ski boot generally comprising a rigid shell bottom below a boot top consisting of a front piece and a rear piece.

The rear piece of the boot top is designed to swing rearward to allow a foot to be inserted. Depending on the type of construction of the boot, it is most often articulated either with respect to the front part of the boot top or the shell bottom. In all cases, connection means hold the boot closed over the lower leg of a skier by bringing together the front and rear pieces that make up the top portion of the boot.

BACKGROUND OF THE INVENTION

These connection means consist of two strands of cable encircling the rear of the upper part of the boot top and extending in parallel around and over the front piece of said boot top, to which they are attached by fastening means making use of anchoring studs and/or a rack and lever as disclosed and claimed in French Pat. No. 2,345,959 filed on Apr. 29, 1976, by the present applicant.

Such connection means may also be applied to ski boots for children. However, it has become clear that very young skiers have difficulty closing and tightening their boot tops correctly using such means. When the boot top is in open position and ready to accommodate a foot, the rear surface of the back cover of the boot is swung rearward and the lever used to tighten the boot over the bottom of the leg is uncoupled from the rack located on one side of the front piece of the boot top. As a result, the two strands of the closure cable may be held to the boot only by the fastening means located on the other side of the front piece of the boot top. Thus they may drift freely in any direction, possibly coming to occupy positions inconsistent with proper closure of the boot. In this way, the upper strand of the cable may become lodged inside the rear cover through inattentive handling on the part of the child, while only the lower strand of said cable occupies its usual position around the rear cover, thereby altering in an unfavorable way the retention of the boot on the wearer's foot.

SUMMARY OF THE INVENTION

The purpose of the invention is to cure the drawbacks set forth above, appearing particularly on children's ski boots, for which the applicant has reduced the height of the boot top in order to adapt the boots better to the morphology of young skiers.

The object of the invention is therefore to provide means for guiding and retaining cable-type lower-leg tightening and closure systems that will keep the latter ready for use by virtue of forcing the connection means to occupy the required position around the rear cover of the ski boots in question, regardless of the height of the top portion of the boots. Another purpose of the invention is to provide means for guiding said connection means of the tightening system in certain positions of the boot, and to permit said connection means to be removed and replaced in case they deteriorate over time. A final purpose of the invention is to provide additional security against loss of the closure system when the latter is uncoupled, by virtue of the fact that said guiding and retention means permanently grasp at least one of the cable sections making up the connection means.

To this end the present invention consists of a device for guiding and retaining a tightening and closure system arranged on two parts of the ski boot that are designed to be brought together over a leg and/or foot of a skier, said device advantageously being removably snapped into an opening provided in the wall of at least one of the boot parts to be brought together and forming a guide tunnel on one of the surfaces of said wall, through which connection means forming part of said tightening/closing system may slip freely.

BRIEF DESCRIPTION OF THE DRAWINGS

The features of the invention are set forth in the following description, which is provided as an example and with reference to the attached drawings.

DESCRIPTION OF PREFERRED EMBODIMENT

Figure 1:
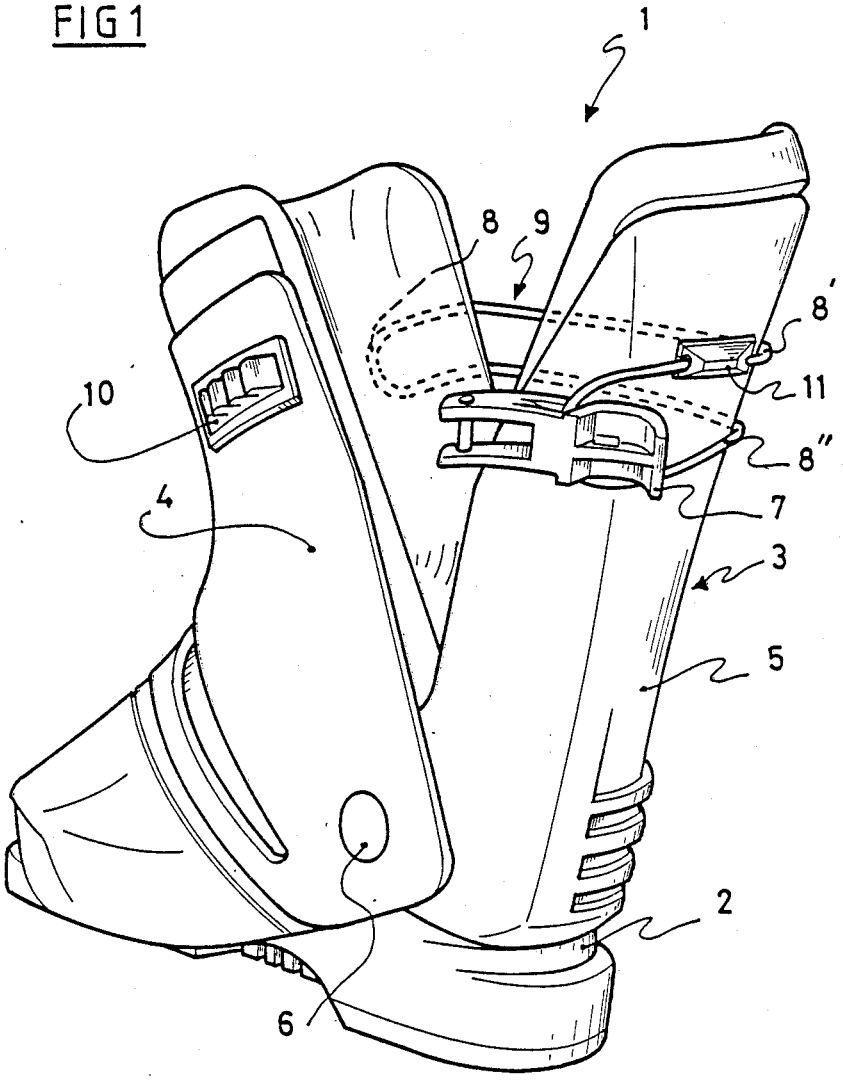
FIG. 1 is a view in perspective of a rear entry ski boot comprising the device for guiding and retaining the connection means of the system for tightening/closing the top portion of said boot.

With reference first to the embodiment of an Alpine ski boot illustrated in FIG. 1, it appears that said boot (1) comprises a shell bottom (2) onto which is mounted a boot top (3) consisting of a front piece known as an oversleeve (4) and a rear piece known as the rear cover (5), at least one of which is articulated with respect to said shell bottom (2).

In the case shown in the figure, rear cover (5) is assembled so as to be pivotable about an axis formed by a swivel rivet (6), so that said rear cover (5) may be swung rearward in order to permit the boot, now in open position (not shown), to be put on from the rear. In closed position, rear cover (5) is held against oversleeve (4) by closure and tightening means consisting of a an actuating lever (7) connected to a flexible loop (8) of a traction cable (9). Said flexible loop (8) is fastened in a known manner to an anchoring stud (not shown) on the other side of oversleeve (4). Actuating lever (7) cooperates with a rack (10) that is integral with the first side of said oversleeve (4). Thus, loop (8), forming two cable strands, one upper (8') and the other lower (8''), encircles the rear surface of said rear cover (5), which it holds against the oversleeve when in closed position.

Upper strand (8') is held in place by passing through a guide device (11) provided at the upper, middle part of the rear cover (5). Said upper strand (8') is simultaneously able to slip freely while the tension of tightening means (7, 8, 10) is being adjusted, and to be held in the correct closed position along the top of rear cover (5). Although it is not shown in FIG. 1, a similar guide device (11) could easily be applied to the lower strand (8'') of the loop.

Figure 3:
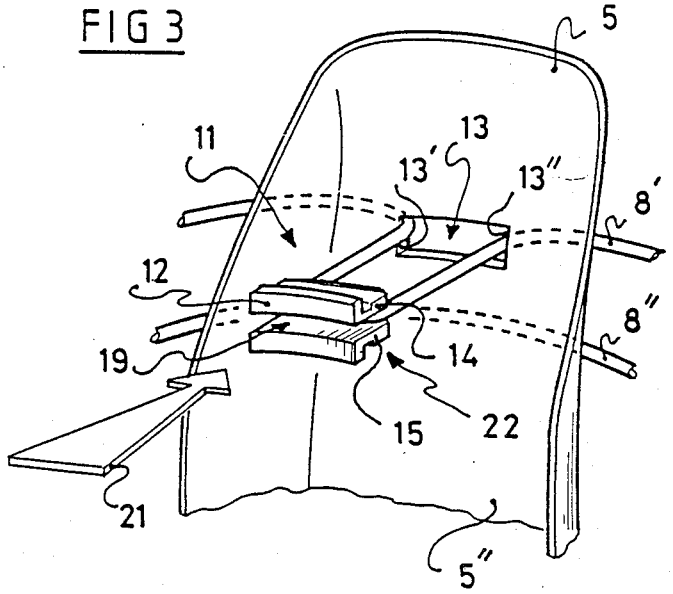
FIG. 3 illustrates, in perspective, the details involved in mounting the device shown in FIG. 2 within the rear part of the top of a ski boot.
Figure 2:
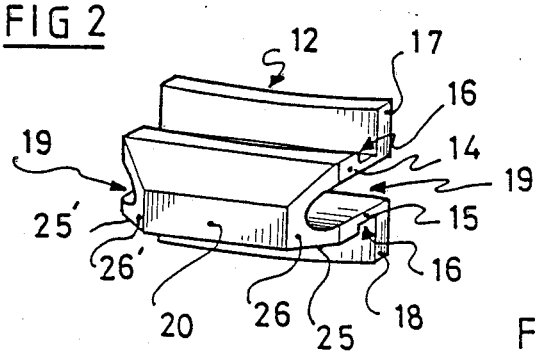
FIG. 2 is a view in perspective of a second embodiment of a guidance and retention device according to the invention, designed particularly to hold connection means having a circular cross-section.

As shown particularly in FIGS. 2 and 3, the guide means (11) consist of a kind of recessed key (12) having a generally U-shaped cross-section, and of an opening (13) the width of which corresponds essentially to that of said key, in the wall of rear cover (5).

Said opening (13) is situated approximately in the plane containing said rack (10), which is integral with oversleeve (4), thus ensuring proper alignment of loop strands (8', 8'') and optimal tension of the tightening means.

Similarly, when lever (7) is uncoupled from rack (10) in order to open rear cover (5), upper cable strand (8') remains retained by recessed key (12), through which it is able to slip until said cover has reached the fully open position. During the entire motion of opening the boot, and while the boot occupies the open position, the closing means remain connected to said rear cover, it being impossible for the loop to assume any position other than that in which it is attached to cover (5). By virtue of the guidance and retention device (11) according to the invention, the end of loop (8) which passes through lever (7) remains in a position to allow easy and direct fastening by a skier, even a very young one, by allowing said skier to apply the lever against rack (10) without having to check whether loop strands (8', 8'') are properly placed on the outer surface of said rear cover (5).

Figure 6:
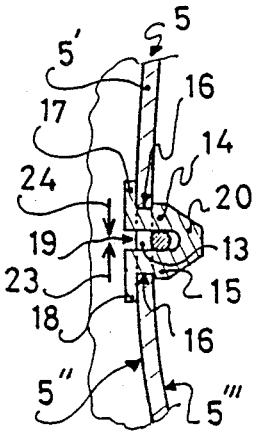
FIG. 6 is a transverse section view of the device in mounted position.

In order to anchor recessed key (12) in the wall of cover (5), the two legs (14, 15) of the U-shaped section each contain a groove (16) of a width corresponding to the thickness of the wall (5') of rear cover (5), as illustrated in FIG. 6. Each leg terminates in a flange (17, 18) that abuts the inner surface (5'') of wall (5') of the cover so that the key will snap into opening (13) in said wall (5'). Advantageously, the height of opening (13) will be slightly less than the distance between the bottoms of grooves (16) so that legs (14, 15) will be subjected to a slight stress when key (12) is mounted in the opening.

Figure 5:
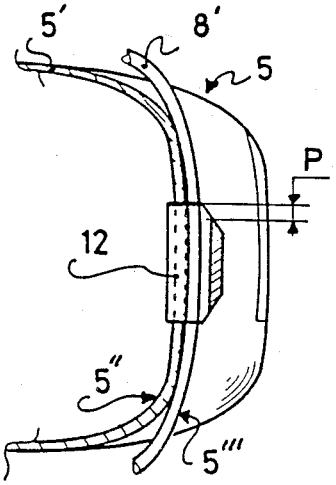

The recess (19) in the U-shaped section of key (12) is oriented toward the interior of the boot top, making it impossible to lose the traction means (in this case cable 9) which are loosely sandwiched between the outer surface (5''') of wall (5') and the bevelled body (20) of said key (12) (FIGS. 5 and 6). The traction means are enabled to slip freely due to the fact that the opening (19) of the U is sightly wider than the diameter of cable (9). For other traction means, such as a strap, the same dimensioning principle would be used as is used here for the cable.

Figure 4:
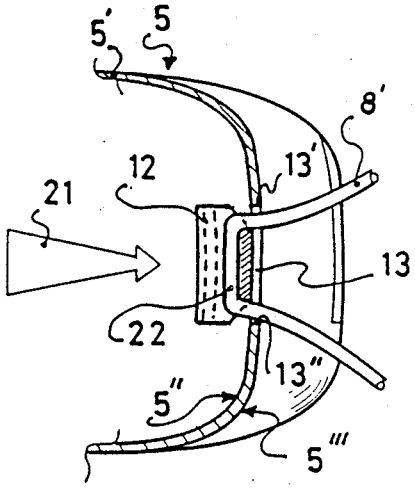
FIGS. 4 and 5 represent the position of the device of the invention before it assumes its place in the wall of a boot top and after it has been inserted into its mounted position in said wall, respectively.

As illustrated particularly in FIGS. 3 through 6, retaining device (11) is mounted by inserting key (12) into opening (13) from the inside of boot top (5) as illustrated by arrow (21). Cable strand (8') is inserted into recess (19) between the legs (14, 15) of the U-shaped key while the latter, which has not yet been snapped into said opening (13), is situated opposite the inner surface (5'') of wall (5'). In order to permit it to be thus inserted into key (12), cable strand (8') is first formed into a temporary loop (22) and passed through opening (13), as illustrated in FIGS. 3 and 4. The bevelled shape of the body (20) of key (12) facilitates insertion of key (12) within opening (13), aided further by the fact that the flexible legs (14, 15) of key (12) draw together by compression, thus reducing the dimension of recess (19). The drawing together of the legs, illustrated by arrows (23), (24) in FIG. 6, thus prevents the cable from escaping as the key is being set into the opening, by virtue of the fact that recess (19) is made smaller than the diameter of cable (9). Finally, recessed key (12) advantageously possesses two insertion chamfers (25, 25') disposed laterally on bevelled body (20). Said insertion chamfers (25, 25') have an angle of contact such that they define a free passageway between the perpendicular sides (13', 13'') of opening (13) and the lateral edges (26, 26') of bevelled body (20), the dimension "p" of said passageway being no less than the diameter of cable (9), or of the thickness of a strap or other connection means, as the case may be.

While this simple and inexpensive device is particularly well suited to rear-entry ski boots equipped with systems using cables to close the top portion of the boot, it may also be adapted, as mentioned above, to systems using straps. In such cases, the shape and dimensions of the guiding device according to the invention shall be appropriate for the size and shape of said strap(s).

It would also be conceivable to provide a ski boot, or a boot or shoe for use in other sports, with several such devices, which may also be applied to laces.

What is claimed is:

1. Device for guiding and retaining a system designed to close two mutually movable parts of a ski boot, said device comprising a recessed key (12) inserted into an opening (13) provided in a part of the boot, a recessed portion of said key forming a channel within which at least one traction cable (9) may slip freely, said traction cable (9) being sandwiched between an outer surface (5''') of said boot part and a solid bottom (20) of said key.

2. Guiding and retaining device according to claim 1, wherein said recessed key (12) has a U-shaped cross-section formed by legs (14, 15) and a bevelled body (20), and a hollow portion of said key corresponds to the recess (19) formed between said legs (14, 15).

3. Guiding and retaining device according to claim 1, wherein said recessed key (12) is removably mounted in said opening (13).

4. Guiding and retaining device according to claim 2, wherein said legs (14, 15) are flexible and each contain a locking groove (16) the dimensions of which correspond to those of upper edges of said opening (13).

5. Guiding and retaining means according to claim 4, wherein the distance between a bottom of each of said grooves (16) in said legs (14, 15) when the latter are in unmounted position is slightly greater than the height of said opening (13).

6. Guiding and retaining means according to claim 2, wherein said legs (14, 15) each comprise a stop flange (17, 18) that makes contact with an inner surface (5'') of said part of said boot containing said opening (13).

7. Guiding and retaining means according to claim 2, wherein the bevelled body (20) of said key (12) comprises two insertion chamfers (25, 25') disposed laterally on either side of the key so as to form a free passageway between sides (13', 13'') of said opening (13) and lateral edges (26, 26') of the solid bottom of said bevelled body (20), the dimension "p" of said passageway being no less than that of the thickness of traction means (9).

8. Rear-entry ski boot comprising:

(a) a shell bottom (2) below a top portion (3) of a boot consisting of an oversleeve (4) and a rear cover (5), of which at least the latter is articulated so that it can be opened when the boot is to be put on; and (b) a tightening and closure system (7, 8, 9, 10) which holds said boot top (3) closed position over a lower leg of a skier;

(c) wherein said rear cover (5) is provided with a device (11) comprising a recessed key (12) inserted into an opening (13) provided in said rear cover (5), for guiding and retaining traction means (9) located on an upper part of the boot top.

* * * * *